US007661747B2

(12) United States Patent
Erskine et al.

(10) Patent No.: US 7,661,747 B2
(45) Date of Patent: Feb. 16, 2010

(54) WINDSHIELD SYSTEM INCLUDING TOWER FRAME

(75) Inventors: Edward J. Erskine, Benson, NY (US); Robert R. Shearer, Bradenton, FL (US)

(73) Assignee: Taylor Made Group, LLC, Gloversville, NY (US)

( * ) Notice: Subject to any disclaimer, the term of this patent is extended or adjusted under 35 U.S.C. 154(b) by 0 days.

(21) Appl. No.: 12/234,364

(22) Filed: Sep. 19, 2008

(65) Prior Publication Data

US 2009/0015032 A1 Jan. 15, 2009

Related U.S. Application Data

(63) Continuation-in-part of application No. 11/970,769, filed on Jan. 8, 2008, now abandoned, which is a continuation of application No. 11/148,222, filed on Jun. 9, 2005, now Pat. No. 7,331,304, which is a continuation-in-part of application No. 10/971,081, filed on Oct. 25, 2004.

(51) Int. Cl.
*B60J 1/02* (2006.01)

(52) U.S. Cl. ..... 296/96.12; 296/84.1; 296/96.21

(58) Field of Classification Search ..... 114/242, 114/343, 361; 403/309–313; 296/84.1, 96.12, 296/96.2, 96.21
See application file for complete search history.

(56) References Cited

U.S. PATENT DOCUMENTS

| | | | |
|---|---|---|---|
| 1,254,566 | A | 1/1918 | Bard |
| 2,432,278 | A | 12/1947 | Bratz |
| 2,739,780 | A | 3/1956 | Richards |
| 2,974,329 | A | 3/1961 | Welch |
| 3,278,203 | A | 10/1966 | Snyder |
| 3,475,079 | A | 10/1969 | Stricker |
| 3,810,267 | A | 5/1974 | Fussell et al. |
| 3,874,706 | A | 4/1975 | Arnold |
| 4,088,348 | A | 5/1978 | Shemtov |
| 4,700,017 | A | 10/1987 | Morand |
| 4,838,195 | A | 6/1989 | Carter |
| 5,003,837 | A | 4/1991 | Italiano |
| 5,303,136 | A | 4/1994 | Brown |
| 5,303,667 | A | 4/1994 | Zirkelbach et al. |
| 5,624,198 | A | 4/1997 | Fuchs |
| 5,979,350 | A | 11/1999 | Larson et al. |
| 6,168,341 | B1 | 1/2001 | Chene et al. |
| 6,328,270 | B1 | 12/2001 | Elberbaum |
| 6,343,888 | B1 | 2/2002 | Huhn et al. |
| D465,194 | S | 11/2002 | Eck |
| 6,672,241 | B2 | 1/2004 | Warfel et al. |
| 7,331,304 | B2 | 2/2008 | Erskine et al. |
| 2003/0075097 | A1 | 4/2003 | Warfel et al. |
| 2004/0180616 | A1 | 9/2004 | Loveless |
| 2004/0258460 | A1 | 12/2004 | Taylor |

*Primary Examiner*—Lori L Lyjak
(74) *Attorney, Agent, or Firm*—Nixon & Vanderhye P.C.

(57) ABSTRACT

A windshield assembly includes a windshield frame constructed to support a windshield. A plurality of couplers are secured to the windshield frame, and a tower frame for a wakeboard tow rope or cable attachment, radar arch or the like is connected to the windshield frame via the couplers. In one arrangement, the couplers are connected to the wing sections of the windshield frame, and the tower frame extends between the wing sections and above an area defined between the wing sections. The integrated tower frame and windshield simplifies installation for the boat manufacturer while accommodating many varieties of tower and windshield configurations.

23 Claims, 4 Drawing Sheets

WINDSHIELD SYSTEM INCLUDING TOWER FRAME

CROSS-REFERENCES TO RELATED APPLICATIONS

This application is a continuation-in-part of U.S. patent application Ser. No. 11/970,769, filed Jan. 8, 2008 now abandoned, which is a continuation of U.S. patent application Ser. No. 11/148,222, filed Jun. 9, 2005, now U.S. Pat. No. 7,331,304; which is a continuation-in-part (CIP) of U.S. patent application Ser. No. 10/971,081, filed Oct. 25, 2004, pending; the entire content of each of which is hereby incorporated by reference in this application.

STATEMENT REGARDING FEDERALLY SPONSORED RESEARCH OR DEVELOPMENT (Not Applicable)

BACKGROUND OF THE INVENTION

The present invention relates to a windshield system and, more particularly, to a windshield system typically for a marine environment that includes an integrated tower frame for supporting a wakeboard tower or the like.

A wakeboard tower is a boat accessory typically extending above and across the passenger area over the boat windshield. The tower is designed to support a tow rope for a wakeboard rider. Typically, the wakeboard tower is comprised of tubular frame elements formed of a sturdy material such as aluminum securely fixed at four points to the boat hull and/or the boat deck. See, for example, U.S. Pat. No. D465,194 and U.S. Pat. No. 5,979,350, the contents of which are hereby incorporated by reference.

There are, however, a number of problems with existing wakeboard tower systems. In some arrangements, the wakeboard towers, once installed, are difficult to remove or are unable to be pivoted into a stowed position. With a system configured for pivotable stowage, in order to ensure proper installation, manufacturing tolerances must be tightened so that the hinge points properly align with one another. Additionally, attaching the wakeboard tower to the boat hull requires suitable connecting structure and additional labor for the boat manufacturer.

BRIEF SUMMARY OF THE INVENTION

It would thus be desirable to integrate a tower frame into a windshield system. Such structure would eliminate the need to secure the tower frame to the boat hull and/or the boat deck and would also serve to reduce manufacturing time and costs. That is, the boat manufacturer need only mount the windshield frame while the tower frame can be easily attached by the end user as an additional accessory. Additionally, with the integrated construction, there are fewer visual obstructions and a less cluttered look. A pivoting joint system for connecting the tower frame to the windshield frame enables the windshield frame to accommodate many varieties of tower configurations.

In an exemplary embodiment of the invention, a windshield assembly includes a windshield frame constructed to support a windshield, the windshield frame including a center section between two wing sections. A tower frame is coupled with the windshield frame and extends between the two wing sections and above an area defined generally within the windshield frame. The tower frame is preferably pivotable between a use position and a stowed position. The tower frame has a load capacity of at least 600 lbs. In one arrangement, the tower frame is coupled with the windshield frame at four attachment points, two on each of the wing sections, wherein at least one of the attachment points on each of the wing sections is a pivot connection. The tower frame may include two U-shaped tubular members and a plurality of tubular connecting members between them. Preferably, the center section of the windshield frame is releasably coupled with the wing sections.

The windshield assembly may additionally include a tower connector attached to each of the wing sections, and a pivot coupler attached to each of the tower connectors, where the tower frame is fixed to the pivot couplers. In this context, the tower connectors may include a threaded coupling, wherein the pivot couplers are secured to the tower connectors respectively via a threaded collar engaging the threaded coupling. The tower frame may be welded to the pivot coupler, and the tower connectors may be welded to the wing sections. The tower connectors and the pivot couplers preferably define a channel for receiving wires or tubing therethrough.

The assembly may alternatively include swing couplers securing the tower connectors and the pivot couplers, respectively. The swing couplers include locking structure engaging the tower connectors and the pivot couplers. In this arrangement, the swing couplers preferably include two pivotably attached C-shaped halves sized to surround connecting portions of the tower connectors and the pivot couplers; and fixing structure that locks the swing couplers in a closed position. The fixing structure may include a swing bolt, a bolt channel, and a locking knob.

In another exemplary embodiment of the invention, a windshield assembly includes a windshield frame, a plurality of removable couplers secured to the windshield frame, and a tower frame connected to the windshield frame via the removable couplers.

In yet another exemplary embodiment of the invention, the windshield assembly includes a windshield frame with a center section and two wing sections removably attached to opposite ends of the center section, a plurality of removable pivot couplers secured to the wing sections, and a tower frame connected to the wing sections via the removable pivot couplers.

BRIEF DESCRIPTION OF THE DRAWINGS

These and other aspects and advantages of the present invention will be described in detail with reference to the accompanying drawings, in which.

DETAILED DESCRIPTION OF THE INVENTION

Figure 1:
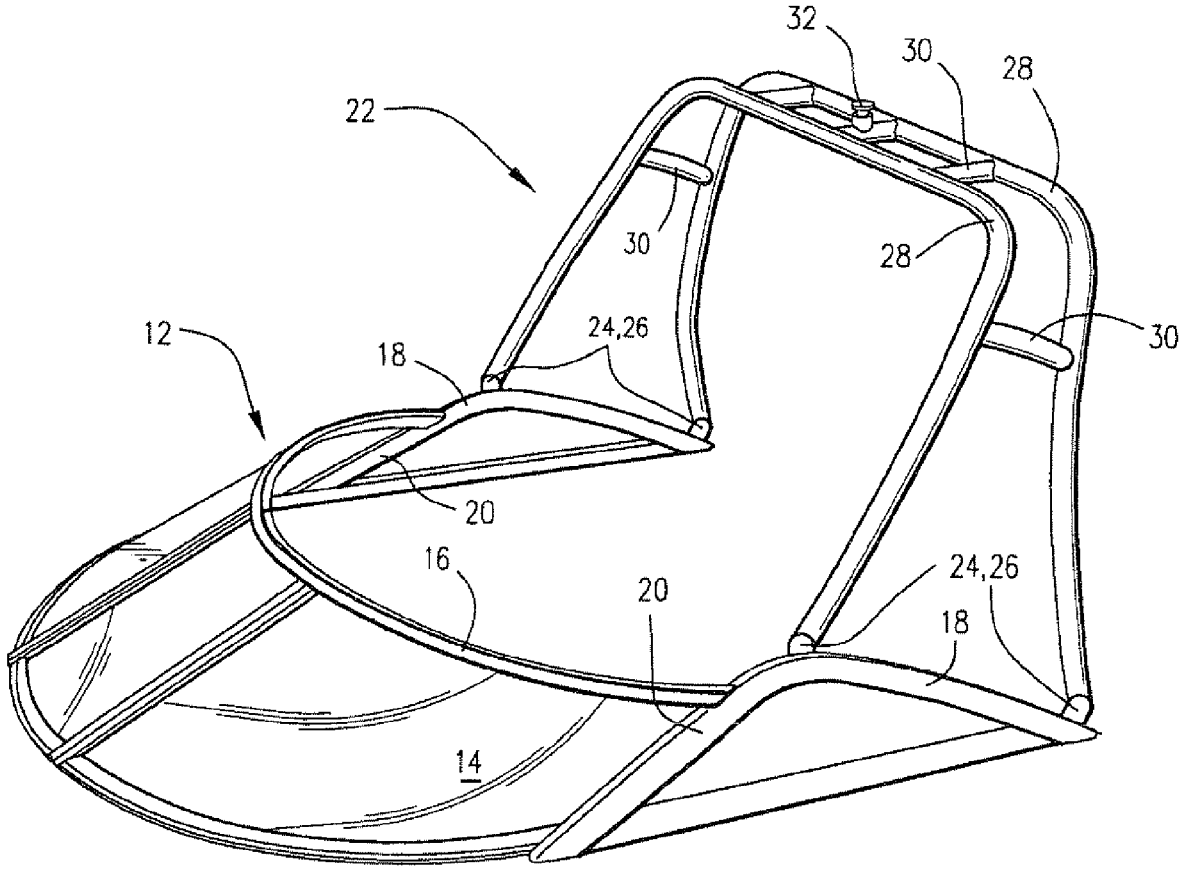
FIG. 1 is a perspective view of an exemplary configuration of a windshield assembly including an integrated tower frame according to the present invention.

FIG. 1 shows an exemplary configuration of the integrated windshield and tower frame according to the present invention. A conventional windshield construction generally includes a windshield frame 12 that is constructed to support a windshield 14 of glass or other suitable material. The windshield frame 12 may include a center section 16 that can be flat or curved (as shown) or any other suitable configuration and a pair of wing sections 18. The wing sections 18 are possibly separately connectable to the center section 16 along a joint line 20 where the wing sections 18 and the center section 16 abut one another. Any suitable connecting structure may be used such as a rail and slot configuration or an abutment connection via a bolt, or the like.

A tower frame 22 is coupled with the windshield frame 12 via a plurality of tower connectors 24 and pivot couplers 26 (described in detail below). The tower frame 22 preferably extends between portions of the windshield frame 12 and generally above an area defined by the windshield frame 12. Preferably, as shown, the tower frame 22 is attached to the wing sections 18 at four attachment points, two on each of the wing sections 18. In one construction, the tower frame 22 is formed of two U-shaped tubular members 28 and a plurality of tubular connecting members 30 between them. A rope or cable attachment member 32 is attached at the top of the tower frame 22 for towing the wakeboard rider. The member 32 may alternatively be a radar unit, hardtop roof or any other structure suited for the application.

Figure 2:
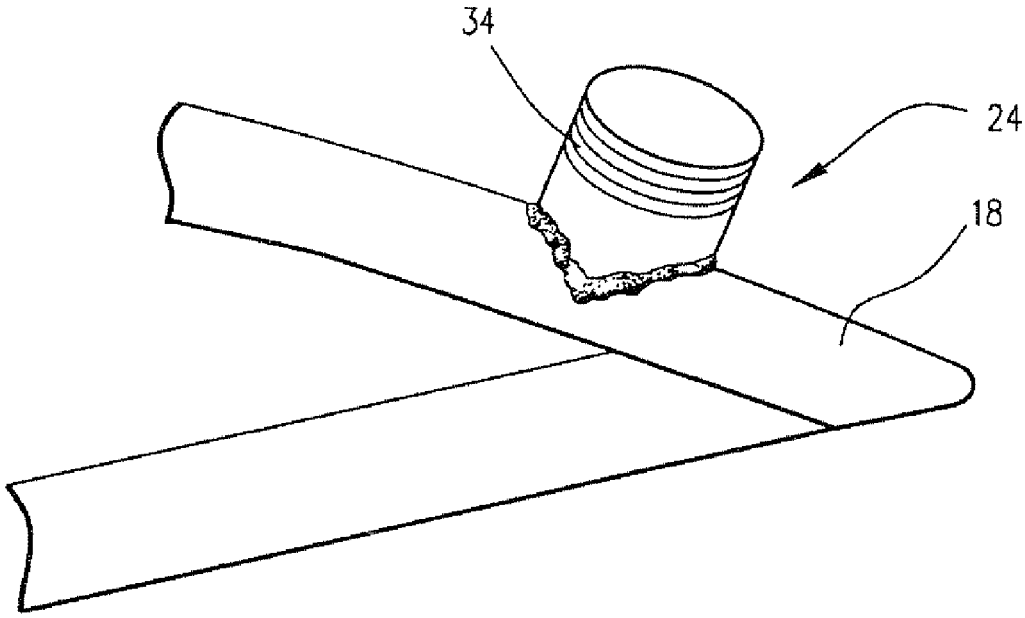
FIG. 2 shows an exemplary tower connector attached to a wing section of the windshield assembly.
Figure 3:
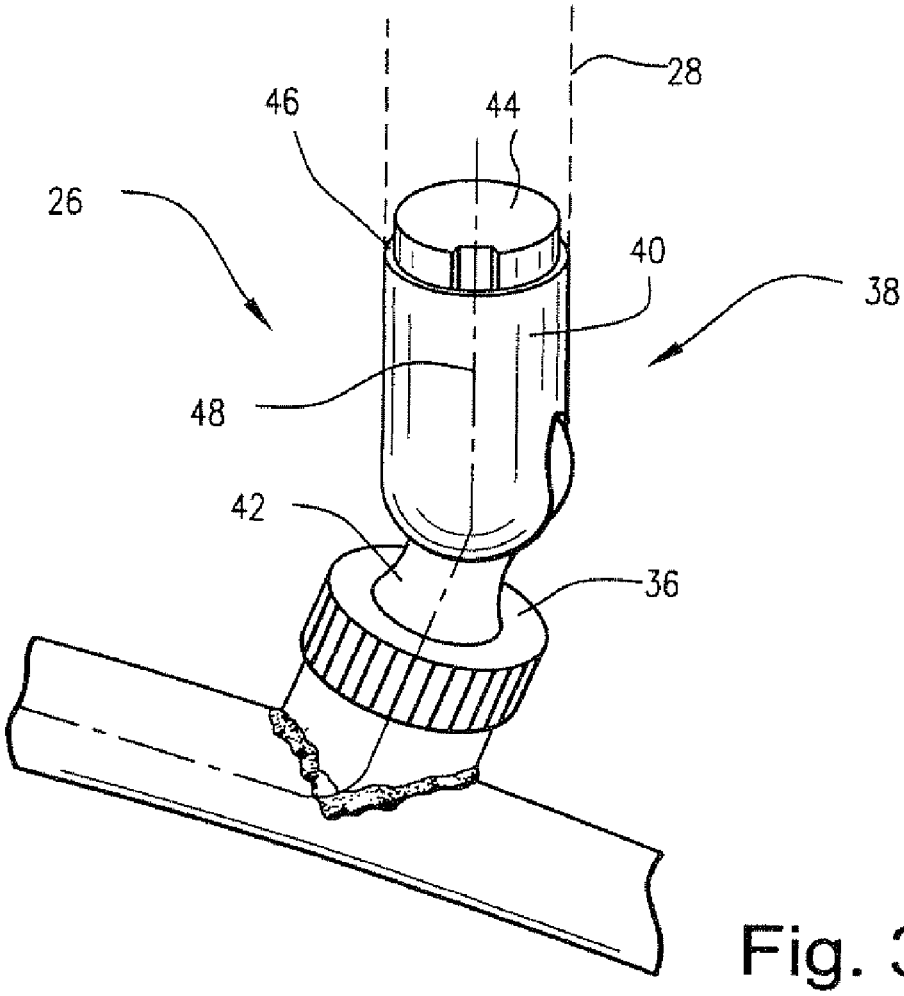
FIG. 3 shows a pivot coupler attached to the tower connector of FIG. 2.

FIGS. 2 and 3 illustrate the connecting components for securing the tower frame 22 to the windshield frame 12. In a preferred arrangement, a tower connector 24 is welded to the wing section 18. Of course, the tower connectors 24 could be attached to the wing sections 18 or center section 16 by any suitable means. The tower connectors 24 are provided with structure for releasably connecting the respective pivot couplers 26. In this context, as shown in FIG. 2, in a preferred exemplary embodiment, the tower connectors 24 are provided with external threads 34 for receiving a collar 36 of the pivot couplers 26. Decorative covers (not shown) may be provided for the tower connectors 24 when the tower frame 22 is not attached.

As described in greater detail in the above-noted parent application, the pivot couplers 26 include a ball assembly 38 to effect pivoting of a pivot member 40 relative to the ball assembly 42. The collar 36 is fit over the ball assembly 42 prior to securing the pivot member 40 in place. The pivot member 40 includes a reduced diameter section 44 defining a shoulder 46. When assembled, ends of the tubular members 28 fit over the reduced diameter section 44 on the shoulders 46 and are secured in place, e.g., by welding or the like. The tower connectors 24 and the pivot couplers 26 define a channel 48 (shown in dash dot line in FIG. 3) for receiving wires or tubing therethrough. Preferably, a hole sized for a multi-wire connector is drilled for the channel 48 into the windshield frame 18.

By virtue of the tower connectors 24 and pivot couplers 26, the tower frame 22 is readily pivotable between a use position and a stowed position. In an exemplary application, the forward pivot couplers 26 fixed to the tower frame may be released from the wing sections 18, via unscrewing the collar 36 or the like, and the tower frame 22 can be pivoted in the aft direction to the stowed position. Alternatively, the aft pivot couplers 26 may be released, and the tower frame 22 can be pivoted in an opposite direction. Of course, other types of couplers, such as non-pivoting couplers, may be used, and the invention is not necessarily meant to be limited to the illustrated structure.

Figure 4:
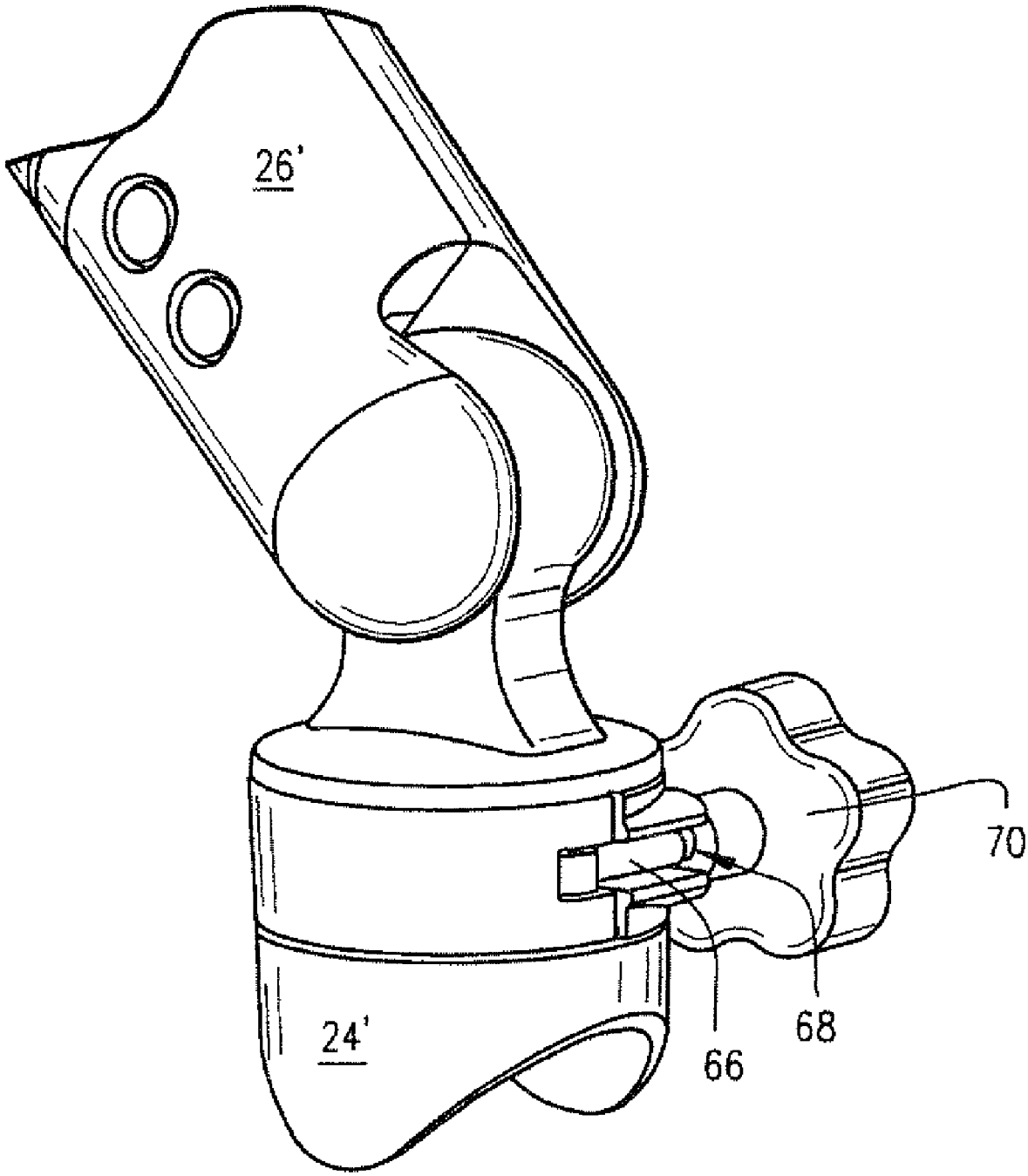
FIG. 4 illustrates an alternative assembly for securing the pivot coupler to the tower connector.
Figure 5:
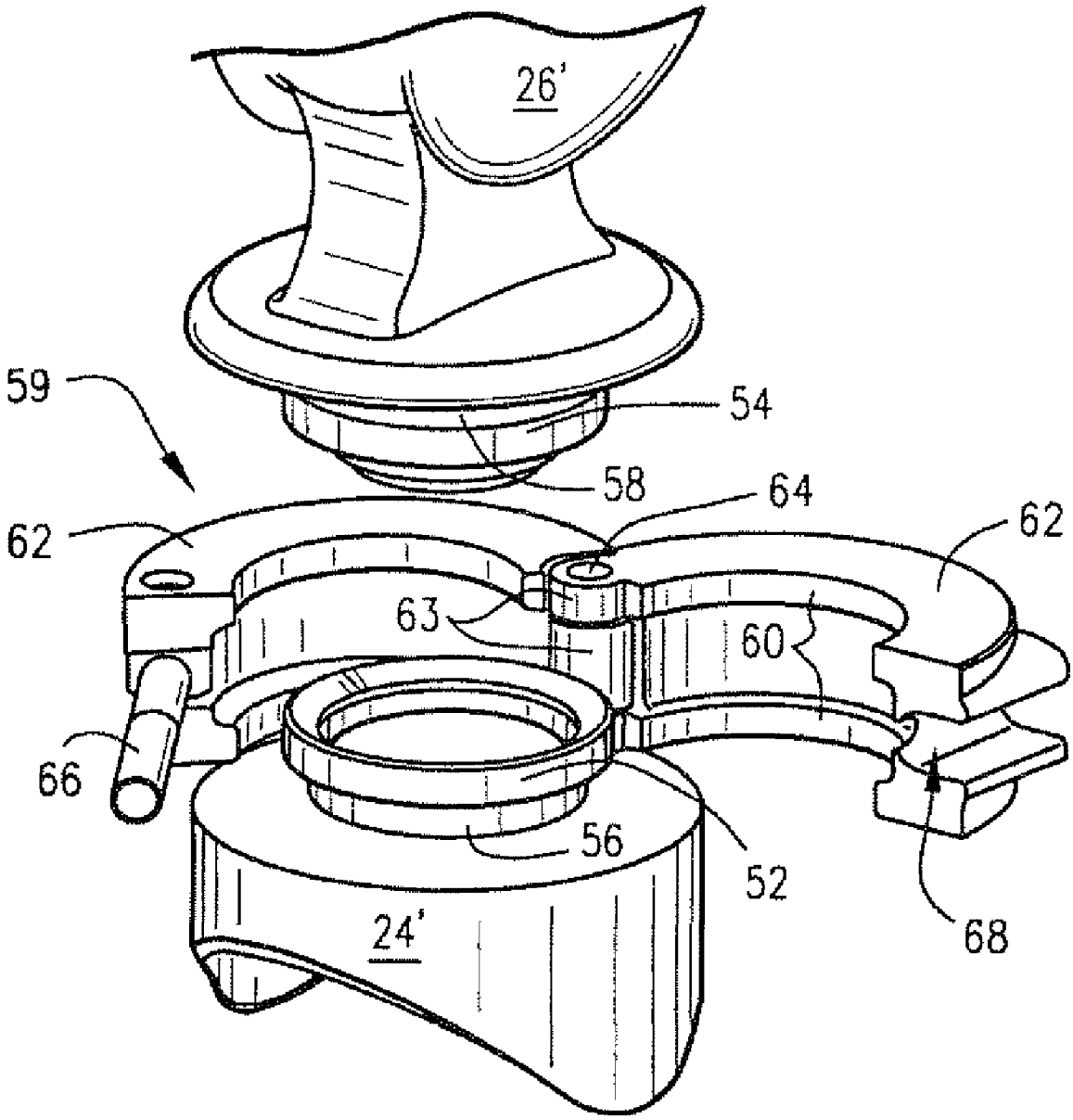
FIG. 5 shows the alternative assembly of FIG. 4 in an open state.

An alternative tower connector 24' and pivot coupler 26' are shown in FIGS. 4 and 5. In some instances, welding the threaded tower connectors 24 may cause distortion and thereby jamming of the threads 34. The alternative connectors 24' and couplers 26' obviate this potential problem and provide a different look. With reference to FIGS. 4 and 5, the tower connector 24' is provided with a coupling stub 52, and the pivot coupler 26' is provided with a coupling plug 54 that is sized to fit adjacent the coupling stub 52. The coupling stub 52 and coupling plug 54 define recessed areas 56, 58 respectively, for receiving shoulder sections 60 of a swing coupler 59.

FIG. 4 shows the swing coupler 59 in a closed position securing the tower connector 24' and the pivot coupler 26' together. The swing coupler 59 includes two C-shaped halves 62 pivotably connected at a pivot joint 63 by a pivot pin 64. The pivot pin 64 is fixed in the tower connector 24'. A swing bolt 66 is pivotably attached to an end of one of the C-shaped halves 62 opposite the pivot joint 63. A corresponding end of the other C-shaped half 62 includes a bolt channel 68 for receiving the swing bolt 66. In the closed position, the swing coupler 59 is secured to the tower connector 24' and pivot coupler 26' such that the shoulder sections 60 engage the recessed areas 56, 58 to prevent the tower connector 24' from separating from the pivot coupler 26'. The swing bolt 66 is received in the bolt channel 68, and a knob 70 is threaded on an end of the swing bolt 66 to thereby lock the swing coupler 59 in the closed position.

The structure of the integrated windshield and tower frame can be distinguished from a conventional Bimini top mounted on a marine windshield. In the Bimini top/windshield system, the Bimini is considerably lighter weight as compared to the integrated windshield/tower frame structure. The Bimini top functions to provide partial protection to the occupants from the elements (sun, rain, etc.). The integrated windshield and tower frame, in contrast, serves to provide a structure that can pull wakeboard riders or the like. The integrated windshield and tower frame additionally provides a base where a Bimini top, wakeboard racks, speakers, etc. can be mounted.

Bimini top tubing normally is fabricated from 0.750"-1.000" diam. aluminum or stainless steel tubing, or square aluminum tubing up to 1.250". The integrated tower frame structure is normally fabricated from 1.500"-2.000", or larger, aluminum pipe. The fittings used to interconnect members of the Bimini top to each are usually of the swivel or pinned type where the integrated tower frame members are welded together. The integrated tower frame structure preferably has a towrope ball welded to a specific location on the tower where the Bimini top does not have a towrope ball. Bimini tops usually have very little lateral (side-to-side) stiffness and tend to be the stiffest forward to aft. The tower is rigid forward to aft as well as side-to-side. The tower is self-supporting in that it will stand alone without collapsing. The Bimini top is not self-supporting and will collapse if the canvas and/or supporting members are not present. The fabric is the binder that provides the strength of a Bimini top, and the aluminum pipe is the strength of the integrated tower frame system. The windshield for the integrated tower frame was designed specifically to support the loads generated by wakeboard riders or the like, and the windshield used to mount a Bimini top was designed to support the Bimini top application only. The wing to deck mounting on the integrated tower frame provides for a robust fastening system that can be modified for different loads, and the Bimini top/windshield wing system is the same as that used to mount a windshield that does not have any accessories (Bimini top) attached to it.

In an effort to determine whether the Bimini top/windshield system provides a structure that can withstand the forces generated by wakeboard riders or the like, a windshield was mounted to a rigid structure, then a Bimini top was attached to the windshield in the usual method. A towrope was attached to the aft main bow and tension was applied to the towrope until the Bimini top/windshield system failed.

Two sheets of 7-ply ¾" plywood were secured to the pavement in the Florida facility of the assignee, Taylor Made Systems. A Monterey 250/270 CR (P/N 5871040045) five-piece glass windshield was attached to the plywood using the 24 #8×1" Phillips Pan Head stainless steel screws supplied in the hardware kit. Two aluminum stanchions were cut to 14" overall length and attached to the windshield and the plywood using the fasteners supplied in the hardware kit. The Bimini top was a Monterey 250CR (P/N 6411-011) four-bow stainless steel top. The aft main bow of the Bimini top was then fastened to the wing top trims approximately 3" aft of the wing/front vertical mull bar using the supplied hardware. The support bars were mounted to the aft end of the wings, again using the supplied hardware. The support straps were secured to the forward end of the plywood using the supplied eye straps and fasteners. A slit was made to the canvas to allow for attachment of the towrope. The towropes, two 15 ft long 7500 lb maximum load nylon recovery slings were secured end to end with the forward end looped around the aft main bow of the Bimini and the aft end of the sling secured to a Transducer Techniques load cell. The other end of the load cell was attached to ¾ ton Ratchet Chain hoist. The hoist was further attached to a 15,000 lb D-ring secured to the pavement 34 ft aft (along the centerline of the windshield) of the towrope attachment on the Bimini.

The windshield was fabricated from five pieces of glass (Fronts: 3/16" thick, Wings and door: ⅛" thick). The top trim was the Vista Magnum aluminum trim and the bottom trim was the Vista Snapless aluminum trim. The windshield was dry glazed (using vinyl gaskets to secure the glass within the trim).

The Bimini top was a four-bow top fabricated from 0.875" diam. 304 stainless steel 18 gauge tubing. The fabric was Seamark vinyl coated woven acrylic (P/N 1002). Standard Bimini top stainless steel fittings were used to attach the members of the top to each other and Taco Metals "Ball & Socket" fittings were used to attach the Bimini top to the windshield.

Once all of the components were secured, the Bimini top/windshield assembly was evaluated. This evaluation consisted of a crude pushing and pulling (forward to aft and side to side) of the assembly. The Bimini top exhibited marginal stiffness forward to aft and very little stiffness side to side.

The initial position, of a drop point on the aft main bow, was recorded. A tensile load was then applied to the towrope and the load was increased to 50 lbs. The new drop point was recorded (see Table 1) relative to a fixed datum point (the aft end of the plywood along the centerline of the windshield). Visual inspection of the assembly was performed and pictures were taken of various areas on the assembly. The load was then increased in 25 lb increments to a complete failure of the assembly at 140 lbs. Visual inspections were performed and pictures were recorded at all intervals.

TABLE 1

Pull Test Recorded Data
Bimini/Windshield Pull Test Conducted on Jan. 8, 2008

| Tensile Load [lb] | Vertical Height [in] | Longitudinal Position Along Centerline (As measured from aft end of plywood) [in] |
|---|---|---|
| Initial Position (No Load) | 59.00 | 12.50 |
| 50 | 57.25 | 16.00 |
| 75 | 56.50 | 18.25 |
| 100 | 55.50 | 21.50 |

TABLE 1-continued

Pull Test Recorded Data
Bimini/Windshield Pull Test Conducted on Jan. 8, 2008

| Tensile Load [lb] | Vertical Height [in] | Longitudinal Position Along Centerline (As measured from aft end of plywood) [in] |
|---|---|---|
| 125 | 54.75 | 25.50 |
| Load Removed for adjustment of strap | 57.50 | 20.50 |
| Canvas Failure at 119 load | — | — |

The data from this test (see Table 1) show that there was substantial movement in the location of the drop point (tow position) when additional tensile loads were applied. At a minimal load of 50 lbs, the drop point had lowered 1.75" and moved aft 3.5".

The Bimini top begins to distort with the minimal 50 lb tensile load. As the load is increased, the fabric distributes the load to the various members of the structure. Additional distortion of the top was seen with the increase in load.

As the load is increased further to 100 lb, the aft main bow appears to show signs of possible permanent distortion. An elongation of the aft main bow and a new drop point was 9.25" aft of the initial position.

At a load of 125 lb, the ratchet chain hoist ran out of chain thereby preventing additional load from being applied. At this time, the drop point had changed from 12.5" to 20.5" and 59.00" to 57.50" between the initial position and the load-removed position, thereby indicating a permanent change in the structure.

One of the tow straps was folded in half to shorten the tow strap and allow for additional aft movement. The test was resumed from zero load. As the load was increased, it was apparent that the top was beginning to fail since the travel of the drop point was increasing with a minimal increase in load. The aft main bow was bending further about the tow point as the load was increased. The forward bow was beginning to bow outward with increased load. Finally, at a load of 119 lb, the canvas tore along the ends of the slit that was made to insert the towrope. The test was again stopped and the Bimini top/windshield structure was evaluated.

At this point, the structure was considered damaged beyond repair.

To determine the next mode of failure, the test was resumed and the load was increased. At a load of 67 lbs, the canvas ripped further. Further increases in load resulted in extreme distortion of the aft main bow. At a load of 97 lbs, the test was paused and the structure was evaluated.

The test was then resumed until at a load of 140 lbs, the forward end of the starboard wing top trim pulled off of the glass. The failure was due to the flat head screw pulled through the countersunk hole on the top trim. The test was resumed, the forward port top trim failed since the flat head screw pulled out of the vertical mull bar.

Still, further testing caused total failure when the aft port end of the top trim separated from the bottom trim. The aluminum in the bottom trim was torn from the hole to the cut in the bottom trim.

At this point, the test was concluded.

Although there are similarities between Bimini top/windshield and the integrated tower frame system, each structure has its own particular function. The Bimini top/windshield structure's primary function is to provide protection from the elements, and the integrated tower frame structure's primary function is to provide a rigid platform to support the loads generated by wakeboard riders or the like.

The testing and load capacity of several integrated tower frame structures and tow towers have been documented. Engineering personnel at Xtreme Marine Inc. stated that the maximum force that wakeboard riders or skiers could generate while being towed behind a boat was 600 lbs. They also established an aft pull test where the tow towers were pulled aft at 1800 lbs (thereby establishing a three-times safety factor). All newly designed towers are tested to this standard. Several integrated tower frame tow towers according to the preferred embodiments described herein were tested in this manner. Furthermore, additional testing of the described integrated towers was performed near the Sea Ray Boat Company Corporate headquarters where the maximum force generated by two wake boarders was found to be 720 lbs. The integrated tower frame system was also tested by the present assignee at the Taylor Made Systems New York facility where the system was tested for safe operation at up to at least 1800 lbs. At least one system was tested to failure at 4200 lbs aft pull. The integrated tower frame system did not exhibit any permanent deformation or failure of any components at 1800 lbs.

This test performed on the Bimini top/windshield was similar in design and function to those performed on the integrated tower frame structures as well as those routinely performed on tow towers fabricated by Xtreme Marine Inc.

Using the Xtreme Marine value of 600 lbs (no safety factor) as the base force that wakeboard riders can generate, it would be expected that a Bimini top/windshield structure is incapable of supporting this load without permanent deformation or failure of any of its components. This would be considered a minimum force that could safely be applied to any tow structure for this application.

The Bimini top/windshield structure was noted as being marginally stiff (spring-like) in the forward to aft direction and very unstable in the side-to-side direction. This test has shown that loads much lower than 600 lbs have caused significant deformation and failure to the Bimini top/windshield structure. The structure was tested in the direction of maximum stability (pulled aft) and was found to be inadequate for use as a tow structure to pull wakeboard riders or the like.

With the structure of the present invention, installation for the boat manufacturer can be simplified whereby only the windshield is required to be mounted while the wakeboard tower frame can be added any time as an accessory. Additionally, the construction of the invention embodies fewer visual obstructions with a less cluttered look. The joint system enables the tower frame to be pivoted while also providing a channel for accommodating wires or tubing or the like. Moreover, the multiple pivot couplers enable the construction to accommodate many varieties of tower configurations and windshield configurations. Still further, securing the tower frame to the wing sections of the windshield spreads the tower loading over a greater area of the boat. That is, with conventional arrangements, the load is concentrated on four points where the tower frame is attached to the boat hull; with the invention, the load is distributed across the windshield frame. The distributed area loading provides for a more stable and secure support structure.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A windshield assembly comprising:

a windshield frame constructed to support a windshield, the windshield frame including a center section between two wing sections;

a tower frame entirely coupled directly to the wing sections of the windshield frame such that the tower frame does not require any other direct attachment to another structure, the tower frame extending between said two wing sections and above an area defined generally within said windshield frame, wherein the tower frame comprises a load capacity of at least 600 lbs; and at least one functional component secured to the tower frame.

2. A windshield assembly according to claim 1, wherein the tower frame is pivotable between a use position and a stowed position.

3. A windshield assembly comprising:

a windshield frame constructed to support a windshield, the windshield frame including a center section between two wing sections;

a tower frame entirely coupled directly to the wing sections of the windshield frame such that the tower frame does not require any other direct attachment to another structure, the tower frame extending between said two wing sections and above an area defined generally within said windshield frame, wherein the tower frame comprises a load capacity of at least 600 lbs; and at least one functional component secured to the tower frame, wherein the tower frame is pivotable between a use position and a stowed position, wherein the tower frame is coupled directly with the windshield frame at four attachment points on the windshield frame, two on each of the wing sections, and wherein at least one of the attachment points on each of the wing sections is a pivot connection.

4. A windshield assembly according to claim 1, wherein the tower frame comprises two U-shaped tubular members and a plurality of tubular connecting members between them.

5. A windshield assembly comprising:

a windshield frame constructed to support a windshield, the windshield frame including a center section between two wing sections;

a tower frame entirely coupled directly to the wing sections of the windshield frame such that the tower frame does not require any other direct attachment to another structure, the tower frame extending between said two wing sections and above an area defined generally within said windshield frame, wherein the tower frame comprises a load capacity of at least 600 lbs; and at least one functional component secured to the tower frame, wherein the center section of the windshield frame is releasably coupled with the wing sections.

6. A windshield assembly comprising:

a windshield frame constructed to support a windshield, the windshield frame including a center section between two wing sections;

a tower frame entirely coupled directly to the wing sections of the windshield frame such that the tower frame does not require any other direct attachment to another structure, the tower frame extending between said two wing sections and above an area defined generally within said windshield frame, wherein the tower frame comprises a load capacity of at least 600 lbs;

at least one functional component secured to the tower frame;

a tower connector attached to each of the wing sections; and a pivot coupler attached to each of the tower connectors, the tower frame being fixed to the pivot couplers.

7. A windshield assembly according to claim 6, wherein the tower connectors comprise a threaded coupling, and wherein the pivot couplers are secured to the tower connectors respectively via a threaded collar engaging the threaded coupling.

8. A windshield assembly according to claim 7, wherein the tower frame is welded to the pivot coupler.

9. A windshield assembly according to claim 6, wherein the tower connectors are welded to the wing sections.

10. A windshield assembly according to claim 6, wherein the tower connectors and the pivot couplers define a channel for receiving wires or tubing therethrough.

11. A windshield assembly according to claim 6, further comprising swing couplers securing the tower connectors and the pivot couplers, respectively, the swing couplers including locking structure engaging the tower connectors and the pivot couplers.

12. A windshield assembly according to claim 11, wherein the swing couplers comprise:

two pivotably attached C-shaped halves sized to surround connecting portions of the tower connectors and the pivot couplers; and fixing structure that locks the swing couplers in a closed position.

13. A windshield assembly according to claim 12, wherein the fixing structure comprises a swing bolt, a bolt channel, and a locking knob.

14. A windshield assembly comprising:

a windshield frame constructed to support a windshield;

a plurality of removable couplers directly secured only to the windshield frame; and a tower frame entirely connected directly to the removable couplers such that the tower frame does not require any other direct attachment to another structure, wherein the tower frame comprises a load capacity of at least 600 lbs.

15. A windshield assembly comprising:

a windshield frame constructed to support a windshield;

a plurality of removable couplers directly secured only to the windshield frame;

a tower frame entirely connected directly to the removable couplers such that the tower frame does not require any other direct attachment to another structure, wherein the tower frame comprises a load capacity of at least 600 lbs; and a plurality of tower connectors attached to the windshield frame, wherein the removable couplers are secured to the windshield frame via the tower connectors.

16. A windshield assembly according to claim 15, wherein the couplers comprise a connecting section releasably securable to the tower connectors and a pivot section securable to the tower frame, the pivot section being pivotable relative to the connecting section.

17. A windshield assembly comprising:

a windshield frame constructed to support a windshield, the windshield frame including a center section and two wing sections removably attached to opposite ends of the center section;

a plurality of removable pivot couplers directly secured only to the wing sections; and a tower frame entirely connected directly to the removable pivot couplers such that the tower frame does not require any other direct attachment to another structure, wherein the tower frame comprises a load capacity of at least 600 lbs.

18. A windshield frame according to claim 17, further comprising a plurality of tower connectors attached to the wing sections; wherein the removable couplers are secured to the wing sections via the tower connectors.

19. A windshield frame according to claim 18, wherein the removable couplers are threaded onto the tower connectors.

20. A windshield frame according to claim 19, wherein the tower connectors are welded to the wing sections.

21. A windshield frame according to claim 18, further comprising swing couplers securing the tower connectors and the pivot couplers, respectively, the swing couplers including locking structure engaging the tower connectors and the pivot couplers.

22. A windshield frame according to claim 21, wherein the swing couplers comprise:

two pivotably attached C-shaped halves sized to surround connecting portions of the tower connectors and the pivot couplers; and fixing structure that locks the swing couplers in a closed position.

23. A windshield frame according to claim 22, wherein the fixing structure comprises a swing bolt, a bolt channel, and a locking knob.

* * * * *